US006923183B2

(12) United States Patent
Martinez et al.

(10) Patent No.: US 6,923,183 B2
(45) Date of Patent: Aug. 2, 2005

(54) BREATHING APPARATUS AND INSTALLATION PROVIDING PROTECTION AGAINST HYPOXIA

(75) Inventors: Patrice Martinez, Le Perray en Yvelines (FR); Eric Farin, Fontenay sous Bois (FR)

(73) Assignee: Intertechnique, Plaisir (FR)

( * ) Notice: Subject to any disclaimer, the term of this patent is extended or adjusted under 35 U.S.C. 154(b) by 128 days.

(21) Appl. No.: 10/190,624

(22) Filed: Jul. 9, 2002

(65) Prior Publication Data

US 2003/0010341 A1 Jan. 16, 2003

(30) Foreign Application Priority Data

Jul. 11, 2001 (FR) ..... 01 09216

(51) Int. Cl.[7] ..... A62B 18/08

(52) U.S. Cl. ..... 128/206.27; 128/207.11; 128/204.21

(58) Field of Search ..... 128/206.27, 207.11, 128/204.21, 204.22, 205.11

(56) References Cited

U.S. PATENT DOCUMENTS

| | | | | | |
|---|---|---|---|---|---|
| 4,870,960 | A | * | 10/1989 | Hradek | 128/202.22 |
| 4,919,124 | A | * | 4/1990 | Stevenson et al. | 128/202.26 |
| 5,165,625 | A | | 11/1992 | Gutman | |
| 5,199,423 | A | * | 4/1993 | Harral et al. | 128/202.26 |
| 5,623,923 | A | * | 4/1997 | Bertheau et al. | 128/207.11 |
| 5,809,999 | A | * | 9/1998 | Lang | 128/200.24 |
| 6,032,668 | A | | 3/2000 | Chung | |
| 6,039,045 | A | * | 3/2000 | Bertheau et al. | 128/207.11 |
| 6,371,110 | B1 | * | 4/2002 | Peterson et al. | 128/202.27 |
| 6,470,887 | B1 | * | 10/2002 | Martinez | 128/207.11 |
| 6,526,967 | B2 | * | 3/2003 | Cordero et al. | 128/200.24 |

FOREIGN PATENT DOCUMENTS

| | | |
|---|---|---|
| FR | 2 784 900 | 4/2000 |
| GB | 836 168 | 6/1960 |
| GB | 851 846 | 10/1960 |
| GB | 1175080 | 12/1969 |

* cited by examiner

*Primary Examiner*—Henry Bennett
*Assistant Examiner*—Amanda Wieker
(74) *Attorney, Agent, or Firm*—Stites & Harbison PLLC; Douglas E. Jackson

(57) ABSTRACT

A breathing apparatus for an aircraft crew member has a breathing mask provided with a demand regulator and connected to a source of breathing gas, such as a pressurized oxygen cylinder or preferably an OBOGS. The apparatus includes an individual buffer plenum specific to the mask on a line for feeding the regulator of the mask from the source. The volume of the plenum is sufficient to provide for at least two typical breaths of the mask wearer in succession. A non-return check valve is located between the plenum and the source.

8 Claims, 1 Drawing Sheet

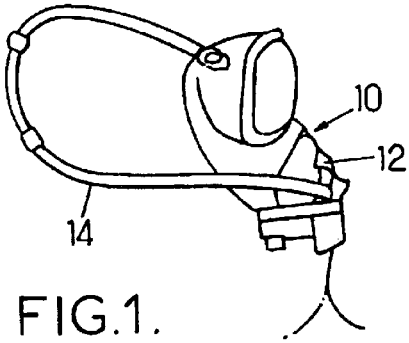
FIG.1.
FIG.2.
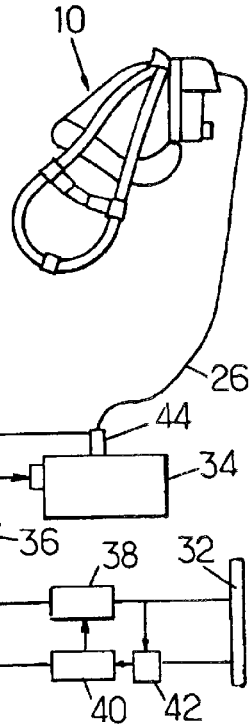
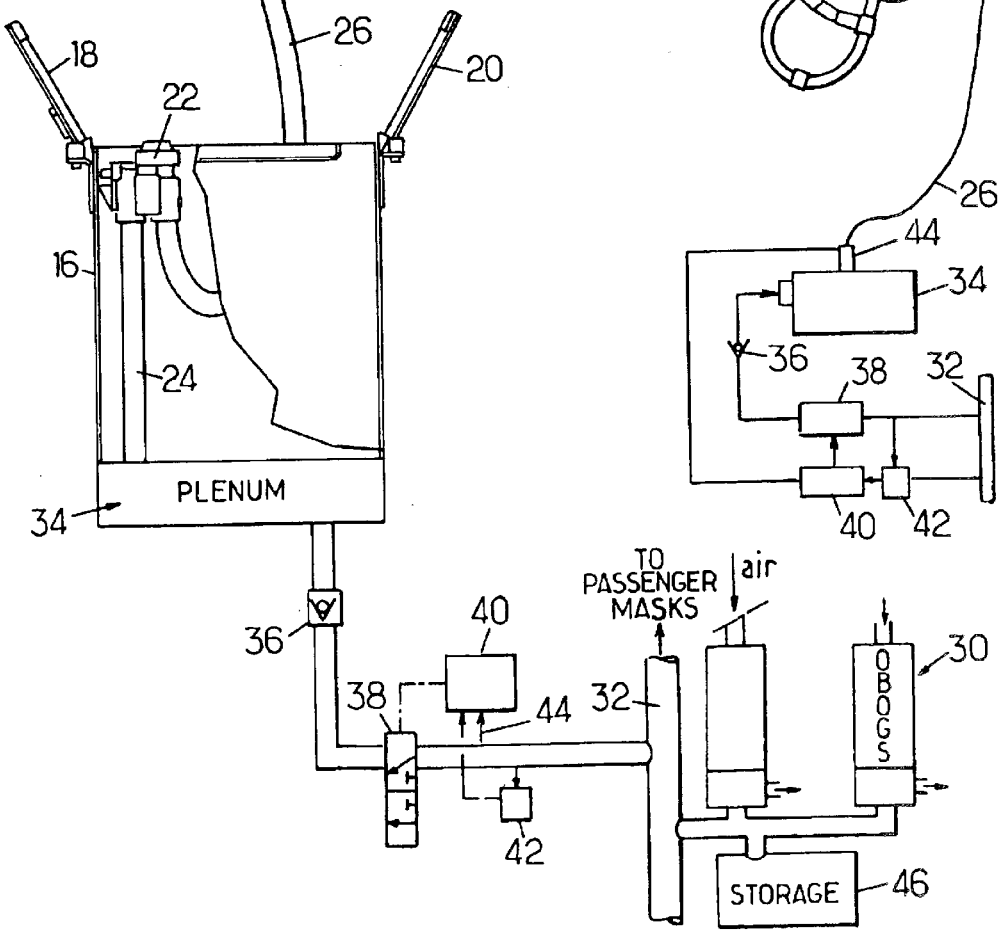

BREATHING APPARATUS AND INSTALLATION PROVIDING PROTECTION AGAINST HYPOXIA

BACKGROUND OF THE INVENTION

The present invention relates to breathing apparatus for protecting crew members, in particular the technical flight crew, of an airplane against the risks associated with depressurization at high altitude and/or the occurence of smoke in the cockpit.

A major, although non-exclusive application lies in passenger airliners that can reach high altitudes, and above all so-called "jumbo" or "super-jumbo" aircraft of very large capacity.

At present, each airliner pilot has breathing apparatus comprising a mask fitted with a demand regulator connected to a source of breathing gas. Aviation regulations require that the mask can be put into place and supply oxygen to its wearer in less than 5 seconds. At present, this result is generally achieved by using a mask with a pneumatic harness that can be inflated and deflated, such as one of those described in documents FR-A-1 506 342 (or GB 1175080), FR-A-2 784 900, and U.S. Pat. No. 5,623,923, the content of which is incorporated herein by way of reference. The source of gas under pressure must be capable of instantly delivering oxygen or air greatly enriched in oxygen at a pressure which is sufficient for inflating the harness and feeding the regulator of the mask. In general, the source is a cylinder of oxygen under pressure.

On airliners, another installation is provided to supply passengers with breathing gas in the event of depressurization and to ensure survival until the airplane has come down to an altitude where normal breathing is possible at ambient atmospheric pressure.

On passenger "jumbos", the necessary supply of oxygen requires a very large weight.

In order to reduce this mass, the oxygen supply can be replaced by an on board oxygen generator, such as a battery of on-board oxygen generator systems (OBOGS) fed with air derived from the compressor of one or more of the engines. However, such generators supply air that is highly enriched in oxygen only after a delay has elapsed from the command to supply oxygen. In addition, the output pressure of an OBOGS depends on the rotational speed of the engine and the air supplied is enriched in oxygen to a degree that is variable. The pressure initially available can be too low to inflate the fast-donning harness. The initial degree of enrichment can also be insufficient. A common buffer tank for acting as a supply of very enriched air is placed at the outlet of the OBOGS, but that solution is far from perfect, particularly since the available pressure can be insufficient for inflating a harness and since the presence of an oxygen transfer pipe causes a further delay. Other types of on-board generator and even common oxygen supplies present similar drawbacks.

SUMMARY OF THE INVENTION

An object of the present invention is to provide an improved breathing apparatus of the type having an oxygen supply and a mask with an inflatable pneumatic harness apparatuses. It is a more specific object to provide apparatus adapted to large capacity airliners having a common supply for the crew and passegers. It is a more particular object to provide apparatus which guarantees that breathing gas at a pressure which is sufficient to make rapid donning possible and guarantees that the oxygen content of the gas breathed in is sufficient from the very first breaths of the user, before the airplane reaches an altitude at which oxygen availability becomes essential, possibly even prior to takeoff.

To this end, there is provided a breathing apparatus having a line for feeding the regulator of a mask, said line including an individual plenum specific to the mask (or to a small number of masks) and of sufficient volume to provide for at least two typical breaths in succession, the plenum being being provided with an inlet check valve for connection to a generator of oxygen or more frequently oxygen-enriched air. The pressure inside said plenum is thus the maximum pressure supplied by the generator during a preceding period.

When using an OBOGS, which deliversgas whose oxygen content varies, in particular depending on the instant in its oxygen-delivery cycle, it is preferable to provide the feed line with a control valve that enables the plenum to be filled initially only when oxygen content is greater than a predetermined threshold, e.g. 94%. The valve can also be kept closed whenever the admission pressure is too low.

Once the first breaths have been breathed and the generator is operating under steady conditions, or in the event of the plenum being emptied while the generator is still not fully satisfying the conditions specified above, means are typically provided to enable gas from the generator to flow freely to the regulator of the mask.

In practice, a plenum for storing 3 to 5 liters of expanded gas suffices. Present mask harnesses generally require a pressure of about 2 bars and a volume of about 1 liter for inflation purposes. As a general rule, an OBOGS delivers pressure that can vary over a ratio of 1 to 6 depending on engine speed. For an OBOGS delivering pressure that varies over the range 0.5 bars to 3 bars, the maximum pressure reached when the engines are at full power for climbing greatly exceeds the pressure required in the plenum.

The invention makes it possible to use a common on-board generator both for the crew and for passengers, and to avoid carrying oxygen cylinders which are heavy and require frequent verification, except cylinders that might be required for possible therapeutic reasons.

The plenum can often be incorporated in a mask storage box which causes oxygen to flow to the regulator on being opened. The plenum is then directly connected to a hose feeding both the regulator and the harness of the mask. This configuration only requires a small increase in the size of a box such as that described in document U.S. Pat. No. 6,039,045, for example.

The above features and others, will be better understood on reading the following description of particular embodiments, given as non-limiting examples. The description refers to the accompanying drawing.

BRIEF DESCRIPTION OF THE DRAWINGS

FIG. 1 is a simplified view of apparatus constituting a particular embodiment of the invention, having a full face mask, and shown with the mask out of the storage box; and FIG. 2 shows a modified embodiment.

DETAILED DESCRIPTION

The apparatus shown in FIG. 1 comprises a breathing mask 10 with a regulator 12 enabling dilution with ambient air and with a pneumatic harness 14 which can be constituted, in particular, by any one of the various types described in the above-mentioned patent applications. When not in use, the mask and the harness are stored in a box 16 provided with a two-flap door 18, 20. A valve 22 carried by the case of the box is interposed between a flexible hose 26 connected to the regulator of the mask and a feed pipe 24. The valve 22 is so placed and arranged to communicate the hose with the pipe 24 when the user of the mask 10 pulls the mask out from the box and the flap 18 opens. Sometimes, the box also carries a switch for selecting between operation of the regulator with dilution (providing protection against hypoxia only) and without dilution (for providing protection against smoke or at very high altitude).

In steady conditions of operation, the pipe 24 receives air highly enriched in oxygen from a generator 30, generally constituted by an OBOGS battery with alternate absorption and delivery cycles. Two OBOGS are shown in FIG. 1. A same single generator feeds a large number of masks. By way of example each OBOGS includes a molecular sieve. Such OBOGS are commercially available, e.g. making use of the dispositions described in U.S. Pat. No. 4,561,865, and the prior art cited therein.

In the embodiment of the invention shown in FIG. 1, a feed line provides a connection between the storage box and an outlet manifold 32 of the generator 30. There is found in succession, from the downstream end to the upstream end of the line: a plenum 34, a non-return check valve 36 and a control valve (typically a solenoid valve) 38. The check valve guarantees that a volume of air that is highly enriched in oxygen under a pressure sufficient to inflate the harness is maintained in the plenum even during periods when the generator 30 is delivering air at a pressure that is lower than the pressure required inside the plenum 34. As illustrated, a three-port control valve 38 is associated with a control module 40 which ensures that, so long as the mask is stored, the plenum is fed with gas coming from the generator 30 only when that gas has an oxygen content in excess of a threshold, e.g. 94 ±2%. For this purpose, a gas analyzer 42 is connected to the feed line to the plenum 34 and supplies a signal to the module 40. The module 40 can also have a pressure takeoff 44 and be arranged or programmed to cut off communication of the manifold 32 with the plenum 34 unless the pressure supplied by the generator exceeds a predetermined value, higher than the value needed to ensure that the harness 14 can be fully inflated.

In a simplified embodiment, the solenoid valve 38 is controlled to put the manifold 32 into communication with the check valve 36 as long as the oxygen content of the breathing gas exceeds the threshold.

In another variant, suitable for use when the source of oxygen-enriched gas initially and immediately provides an oxygen content that is sufficiently high, the valve 38 can be omitted.

In another variant, the module 40 is designed to control the solenoid valve so as to put the manifold 32 into communication with the check valve 36 on receiving a signal indicating that the flap 18 of the box has been opened. This ensures that the mask is fed continuously while it is being worn.

In the modified embodiment shown in FIG. 2, the mask 10 is designed to be stored other than in a mask box. It is connected by the flexible hose 26 to a separate plenum. The connection between the plenum 34 and a solenoid valve 38 includes a non-return check valve 36. In the example shown, the solenoid valve 38 is connected to a control module 40 which puts the manifold 32 into communication with the check valve 36:

when the oxygen content as measured by a gas analyzer 42 exceeds a determined value; and when the pressure in the plenum 34 as measured by a sensor 44 is below a determined value, so as to provide breathing gas directly from the source.

Other embodiments are also possible, optionally using solenoid valves, in particular depending on the nature of generator 30.

The bank of OBOGS is typically for supplying boxes containing emergency passenger masks, as well as the masks of the crew members, with oxygen enriched air.

When using OBOGS generators, an exemplary method of operating the complete installation is as follows.

During initial climbing of the airplane after takeoff, at least one of the generators 30 is put into operation to extract oxygen selectively. Since the jet engines are then operating at full power the air which passes through the molecular sieve of the generator is at high pressure.

Once the molecular sieve becomes saturated, atmospheric air feed is transferred to another OBOGS. A set of valves provided on the first OBOGS is controlled so as to communicate the outlet of the OBOGS with the manifold 32 and the OBOGS is heated to deliver oxygen. Since the pressure is high, and since the gas has a high oxygen content, the individual buffer plenums 34 are filled to a pressure that is sufficient for inflating harnesses. Means can be provided to deplete the buffer plenum of the air it might have been contained prior to being filled with oxygen enriched air under pressure. One or more common storage tanks 46 can also be filled at this stage in addition to the individual plenums.

Once these operations have been performed and the second OBOGS has also become saturated in oxygen, the first OBOGS can be refilled so as to ensure that a maximum supply of oxygen enriched air is available.

In a variant, at least one of the generators is controlled to implement an absorption/delivery cycle prior to take-off so that the pilots have oxygen-rich gas under pressure available and suitable for enabling them to don their masks, e.g. in the event of smoke.

Under all circumstances, the pilots are able to don the breathing mask in a few seconds whatever the altitude and very highly enriched breathing gas is immediately avalable for breathing.

One or more common tanks give the passengers access to oxygen as well, but with a delay that can be somewhat longer. Since the generators are initially saturated in oxygen and under pressure, they enable the feed to be maintained under high pressure during the time needed to descend to an end-of-cruising altitude, in the range 5000 meters to 8000 meters, where a lower pressure suffices for breathing requirements, and where pressure is indeed lower because the engines are operating at reduced speed.

Numerous possible modifications will immediately appear to those familiar with the relevant art. For instance a same plenum of increased capacity can be shared between two pilots.

What is claimed is:

1. Breathing apparatus for an aircraft crew member, comprising:

a generator of oxygen-enriched air, a breathing mask provided with a demand regulator, an inflatable pneumatic harness, an individual buffer plenum having an outlet connected to the regulator of the mask on a line for feeding the regulator of the mask and for feeding the harness, connecting means having a non-return check valve between the generator and the plenum, said plenum having a volume sufficient to provide for at least two typical breaths in succession of said crew member and in which the pressure is sufficient to make a rapid donning of the harness, said connecting means further comprising valve means for preventing initial filling of said buffer plenum from said generator until an oxygen content of the gas delivered by the generator exceeds a predetermined threshold and for preventing initial filling of said buffer plenum from said generator until an outlet pressure of the generator exceeds a predetermined value;

a sensor providing a signal representative of the oxygen content of gas delivered by the generator; and an electronic module connected to receive said signal and control said valve means which is a solenoid valve, wherein the module is arranged to also put the generator and the non-return check valve into communication in response to opening of a box containing the mask.

2. An apparatus according to claim 1, wherein the generator is a bank of OBOGS.

3. Breathing apparatus for an aircraft crew member, comprising:

a generator of oxygen-enriched air, a breathing mask provided with a demand regulator and a pneumatic harness apt to be inflated and deflated, an individual buffer plenum having an outlet connected to a line for feeding the demand regulator of the mask and for feeding the harness, connecting means having a non-return check valve between the generator and the plenum, said plenum having a volume sufficient to provide for at least complete inflation of the harness and two typical breaths in succession of said crew member, and a box for storing said mask, said box having a case, a door and a valve arranged to connect said plenum to said demand regulator, responsive to opening of said door.

4. Breathing apparatus according to claim 3, wherein said connecting means further comprise valve means for preventing initial filling of said buffer plenum from said generator until an oxygen content of the gas delivered by the generator exceeds a predetermined threshold.

5. Breathing apparatus according to claim 4, wherein said threshold is 94% by weight.

6. Breathing apparatus according to claim 3, wherein said plenum constitutes part of said box.

7. Breathing apparatus according to claim 3, wherein said generator is a common bank of OBOGS also for delivery of oxygen-enriched air to a manifold supplying passenger masks in the aircraft.

8. Breathing apparatus according to claim 3, wherein an electronic module is arranged to control a solenoid valve so as to put a manifold into communication with a check valve on receiving a signal indicating that the door of the box has been opened.

* * * * *